US010760363B2

(12) United States Patent
Tom et al.

(10) Patent No.: US 10,760,363 B2
(45) Date of Patent: Sep. 1, 2020

(54) LOCK RING SEGMENTS BIASED INTO LOCKED POSITION WHILE RETAINED IN POSITION WITH AN EXTERIOR PROFILE

(71) Applicant: Baker Hughes, a GE company, LLC, Houston, TX (US)

(72) Inventors: Andy Tom, Houston, TX (US); Christopher R. Hern, Porter, TX (US); Frank J. Maenza, Houston, TX (US); Mahmoud Marzouk, Rosharon, TX (US); Jeffrey C. Williams, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 259 days.

(21) Appl. No.: 15/898,830

(22) Filed: Feb. 19, 2018

(65) Prior Publication Data

US 2019/0257164 A1 Aug. 22, 2019

(51) Int. Cl.
*E21B 23/01* (2006.01)

(52) U.S. Cl.
CPC ..... *E21B 23/01* (2013.01)

(58) Field of Classification Search
CPC ..... E21B 23/00; E21B 23/01
See application file for complete search history.

(56) References Cited

U.S. PATENT DOCUMENTS

| | | | | |
|---|---|---|---|---|
| 4,614,233 | A * | 9/1986 | Menard | E21B 47/0905 166/206 |
| 4,660,637 | A * | 4/1987 | McGill | E21B 23/06 166/120 |
| 4,690,220 | A * | 9/1987 | Braddick | E21B 33/1292 166/124 |
| 5,120,085 | A * | 6/1992 | Shin | F16L 37/0842 285/317 |
| 5,467,819 | A * | 11/1995 | Braddick | E21B 7/061 166/117.6 |
| 6,202,747 | B1 * | 3/2001 | Lacy | E21B 33/1295 166/120 |
| 6,209,653 | B1 | 4/2001 | Pringle | |
| 7,222,889 | B2 | 5/2007 | Breay | |
| 7,448,591 | B2 | 11/2008 | Ross | |
| 9,816,339 | B2 * | 11/2017 | Xu | E21B 33/12 |
| 10,233,709 | B2 | 3/2019 | Meador et al. | |
| 2002/0162667 | A1 * | 11/2002 | Ingram | E21B 17/06 166/387 |

(Continued)

*Primary Examiner* — Steven A MacDonald
*Assistant Examiner* — William D Hutton, Jr.
(74) *Attorney, Agent, or Firm* — Shawn Hunter

(57) ABSTRACT

Ratchet locking segments permit one direction relative movement and then prevent reverse movement to hold a set position of a tool. The segments are axially supported in a surrounding housing using an exterior profile on each segment meshing with a conforming profile on the outer housing. The meshing is loose to allow the segments the ability to move radially while supported axially. Biasing of opposed ratcheting segments toward each other is provided by a spring or springs at opposed axial ends of each segment or within the exterior profile between the axial ends. The end biasing can be done with coiled springs or bent tabs that store potential energy when assembled or with wave springs between the segment outer profile and a surrounding outer housing.

11 Claims, 6 Drawing Sheets

(56) References Cited

U.S. PATENT DOCUMENTS

| | | | | |
|---|---|---|---|---|
| 2005/0077053 | A1* | 4/2005 | Walker | E21B 33/1295 166/387 |
| 2008/0001111 | A1* | 1/2008 | Ross | E21B 23/04 251/230 |
| 2012/0012303 | A1* | 1/2012 | Xu | E21B 23/00 166/88.2 |
| 2012/0042966 | A1* | 2/2012 | Ross | E21B 34/103 137/517 |
| 2016/0168945 | A1 | 6/2016 | Halbert et al. | |
| 2017/0167217 | A1 | 6/2017 | Kam et al. | |

* cited by examiner

LOCK RING SEGMENTS BIASED INTO LOCKED POSITION WHILE RETAINED IN POSITION WITH AN EXTERIOR PROFILE

FIELD OF THE INVENTION

The field of the invention is ratcheting lock ring segments that have exterior profiles to allow the segments to move radially while retaining the segments axially as a bias force is applied at ends or in between ends within the exterior profile.

BACKGROUND OF THE INVENTION

Many borehole tools need to lock to hold their set position. This has been accomplished in the past with body lock rings that are typically a single piece with a split for ease of assembly and for retention of a net potential energy force, typically toward an internal mandrel that has one part of a mating ratchet profile. The lock ring has a mating part of the ratchet profile so that relative movement with respect to a mandrel of an outer assembly that has the lock ring will bring the ratchet pattern on the lock ring into contact with the ratchet pattern on the mandrel. Because of the shape of the opposed profiles that come into contact during setting movement, relative movement of an outer assembly around the mandrel and the mandrel itself is permitted until the tool sets. Relative movement in an opposite direction is prevented by the shape of the mating ratchet profiles.

The ratchet ring can be a 360 degree complete ring with axially extending spaced segments as described in US 20170167217. Other examples of traditional locking rings can be seen in U.S. Pat. Nos. 7,448,591; 6,209,653 and 7,222,889.

Using biased lock ring segments in close end spacing is illustrated in US 20160168945 in FIG. 8. The segments are spring biased from recesses in an exterior elongated lug that retains the segments axially in a recess in a surrounding housing. The biasing springs abut the recess and push the lug toward a mating pattern on an internal mandrel. This reference allows for the segments to be pushed out from within mandrel openings so as to release the set position of a tool for retrieval.

U.S. application Ser. No. 15/259,246 reveals the use of spaced lock ring segments with sufficient circumferential gaps to accept bars that transfer force past lock rings to a settable component below in a situation where another tool component has been set earlier without a substantial drift reduction of a passage through the tool.

What is needed and offered by the present invention is a retention feature on the outer surface of the locking segments that allows them to be radially biased into an opposed ratchet profile so that relative movement in a first direction is enabled by ratcheting as the segment jumps an opposing profile mounted to a mandrel, for example. The segments can be supported on a mandrel or on an opposing housing and still operate in the same manner. Relative movement in the opposite direction is prevented by each segment as each such segment is retained against axial movement by an outer profile that can be a spiral pattern, undulating parallel ridges or other patterns that are either discrete or continuous as will be explained below. A bias can be applied at one or both axial ends of each segment or in between ends. The biasing can be realized by coiled or wave springs located between the outer face of the segments and the mating retention profile in a surrounding outer housing. These and other aspects of the present invention will be more readily apparent to those skilled in the art from a review of the detailed description of the preferred embodiment and the associated drawings while recognizing that the full scope of the invention is to be determined from the appended claims.

SUMMARY OF THE INVENTION

Ratchet locking segments permit one direction relative movement, either initially partially or for the full range of allowed relative movement in that direction, and then prevent reverse movement to hold a set position of a tool. The segments are axially supported in a surrounding housing using an exterior profile on each segment meshing with a conforming profile on the outer housing. The meshing is loose to allow the segments the ability to move radially while supported axially. Biasing of opposed ratcheting segments toward each other is provided by a spring or springs at opposed axial ends of each segment or within the exterior profile between the axial ends. The end biasing can be done with coiled springs or bent tabs that store potential energy when assembled or with wave springs between the segment outer profile and a surrounding outer housing.

BRIEF DESCRIPTION OF THE DRAWINGS

FIG. 2 is an axial section view through a mandrel and an outer housing showing a locking segment in between;

DETAILED DESCRIPTION OF THE PREFERRED EMBODIMENT

Figure 1:
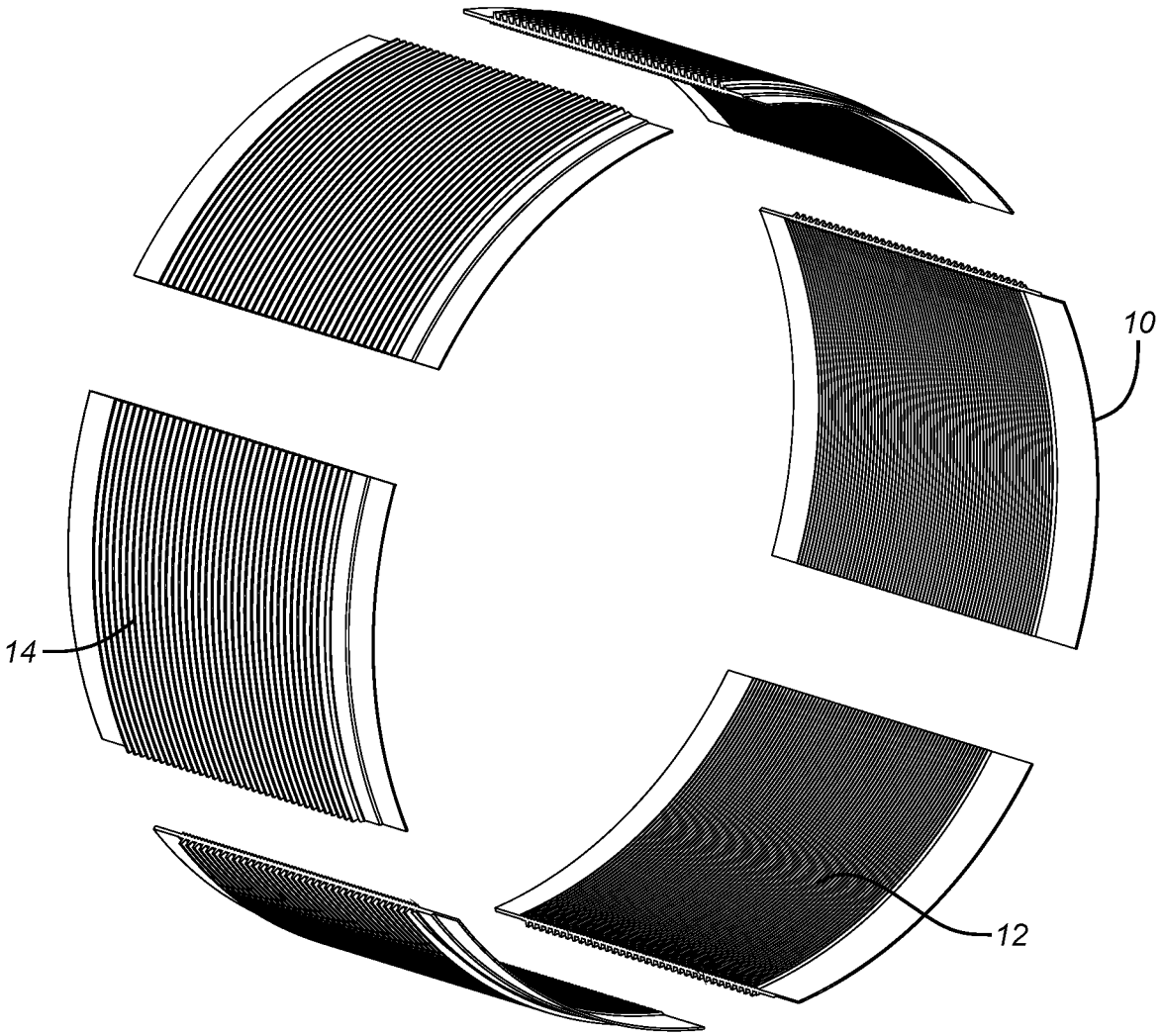
FIG. 1 is a perspective view of six segments for locking to show the internal and external patterns on each segment.

Referring to FIG. 1 a perspective view of locking segments 10 shows that each of the illustrated six segments 10 have an interior profile for ratcheting in relative movement in one direction and locking against opposed relative movement. The exterior profile 14 serves to axially retain each segment 10 while allowing the segment 10 to move radially inwardly under a bias force or outwardly when overcoming the bias force during ratcheting while being supported axially as will be explained below. While six segments are shown, those skilled in the art will appreciate that other quantities could be used without departing from the invention. The segments can be formed from a ring that is cut into one or more pieces and mounted with circumferential spacing or a gap in the case of a single piece or the segments can be discrete structures, with or without curvature as long as facing mating profiles can engage to allow relative movement in one direction and prevent such relative movement in an opposed direction. While large gaps are shown in FIG. 1 between the segments 10 the segments can be closely spaced or the gaps can be wide enough to allow other relatively moving members to pass in between to operate portions of a borehole tool.

Figure 2:
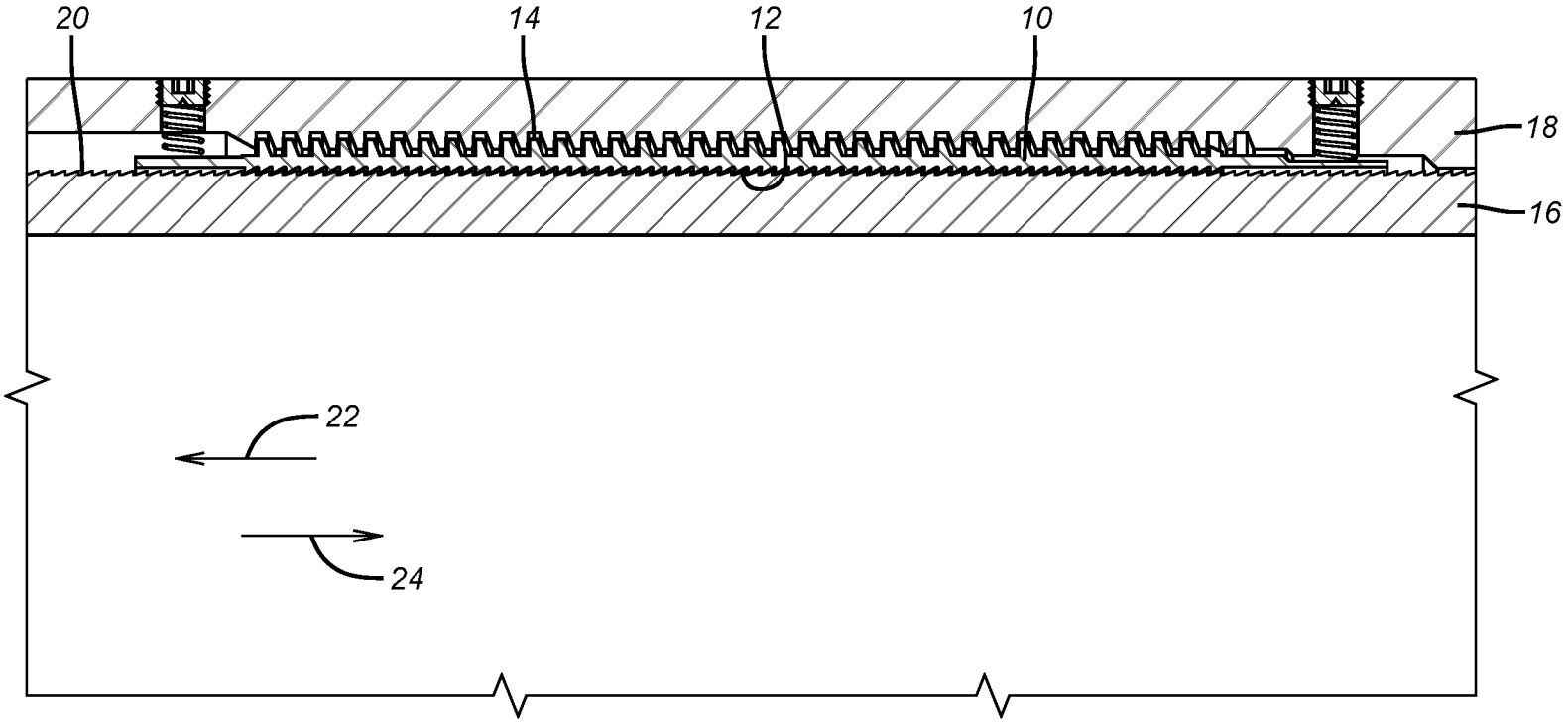
Figure 3:
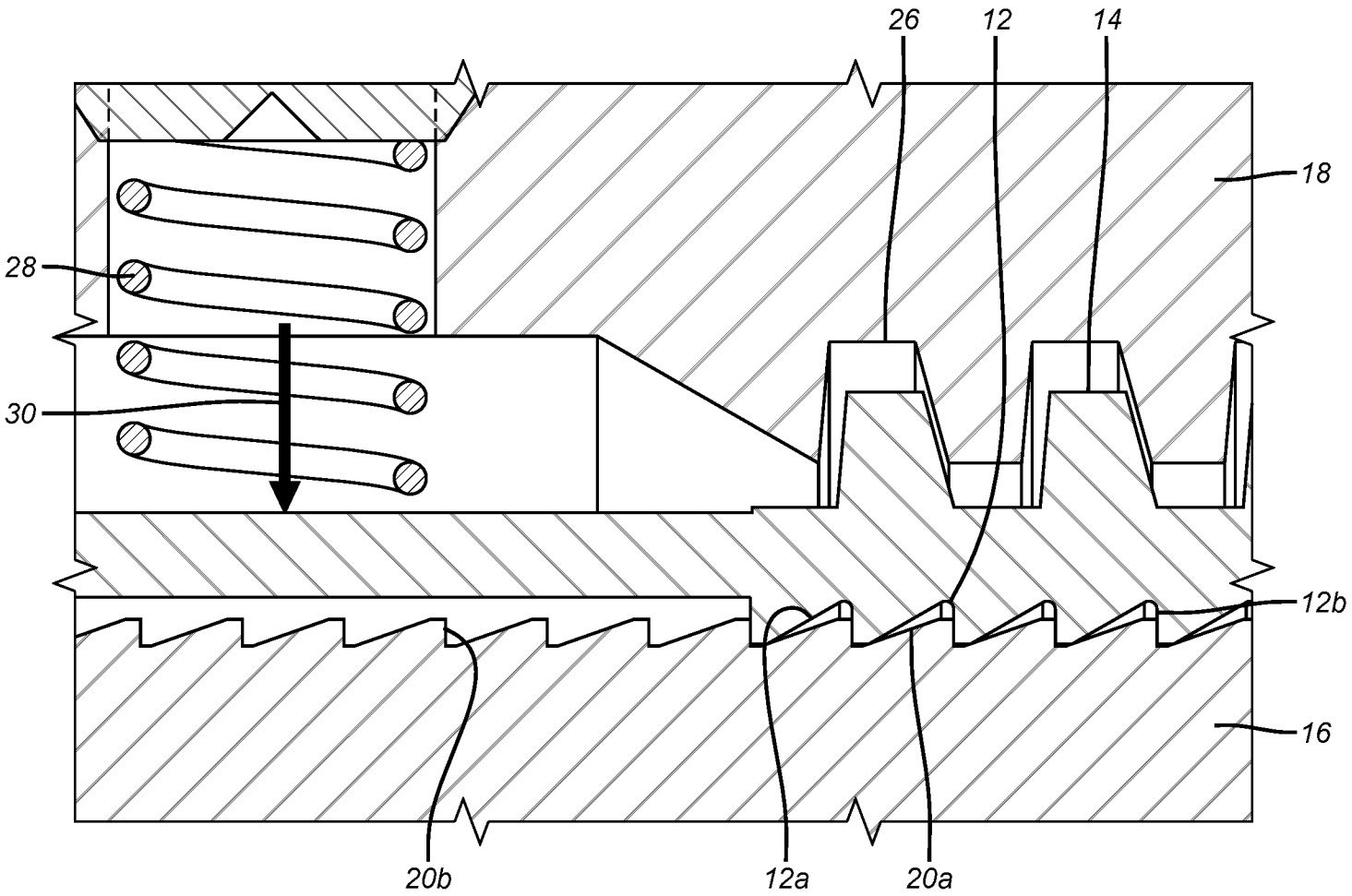
FIG. 3 is a close up detail of FIG. 2 showing a radial inward bias from an axial end of a locking segment and the set and locked position.

FIG. 2 is a section through a segment 10 that shows a mandrel 16 within an outer assembly 18. Mandrel 16 has one portion 20 of a ratchet pair while the facing portion 12 is on each locking segment 10 comprises the other part of the ratchet pair. Mandrel 16 or housing 18 is movable in the direction of arrow 22 relative to the outer assembly 18 as ratchet profile ramps 12*a* are pushed up radially away from mandrel 16 on ramps 20*a* of moving mandrel 16 for the set position. The segments 10 can move out radially because outer profile 14 has room for axial and radial movement in mating profile 26 as shown in FIG. 3. Opposed mandrel movement in the direction of arrow 24 is prevented as radial surfaces 20*b* on mandrel profile 20 abut radial surfaces 12*b* on the lock ring segment 10. At the time the position of FIG. 3 is attained the outer assembly 18 interacts with the borehole wall or surrounding tubular for a set position. Some examples of devices that can be part of the outer assembly 18 can be anchor slips or a seal assembly that are not shown. In this manner relative movement of the mandrel 16 in the direction of arrow 22 causes repeated radial movements of segments 10 away from mandrel 16 as the ratcheting movement takes place. Each time the segments 10 move out radially a bias on each segment that can be a spring 28 that is preferably a coiled spring and is preferably located on at least one side but preferably opposed sides of mating profile 26 is overcome as each segment 10 moves radially away from mandrel 16, or the housing 18 depending on the configuration, that is translating in the direction of arrow 22. Spring 28 can be guided internally of its coil, if it is a coiled spring, and otherwise guided externally within profile 26 or elsewhere along a segment 10 or by outer assembly 18. Alternatively, spring 28 can be within the profile 26. Spring 28 has the purpose of applying a biasing force on its associated locking segment 10 toward mandrel 16 while allowing each associated locking segment 10 the ability to move radially away from mandrel 16 to enable the ratcheting movement of mandrel 16 in the direction of arrow 22. Arrow 30 illustrates the spring force on the locking segment 10 toward mandrel 16. That force represented by arrow 30 is overcome several times as the ratcheting takes place with mandrel 16 moving in the direction of arrow 22. That force toward mandrel 16 is overcome during ratcheting as the segments 10 are pushed away from mandrel 16 as indicated schematically by arrow 32.

Figure 4:
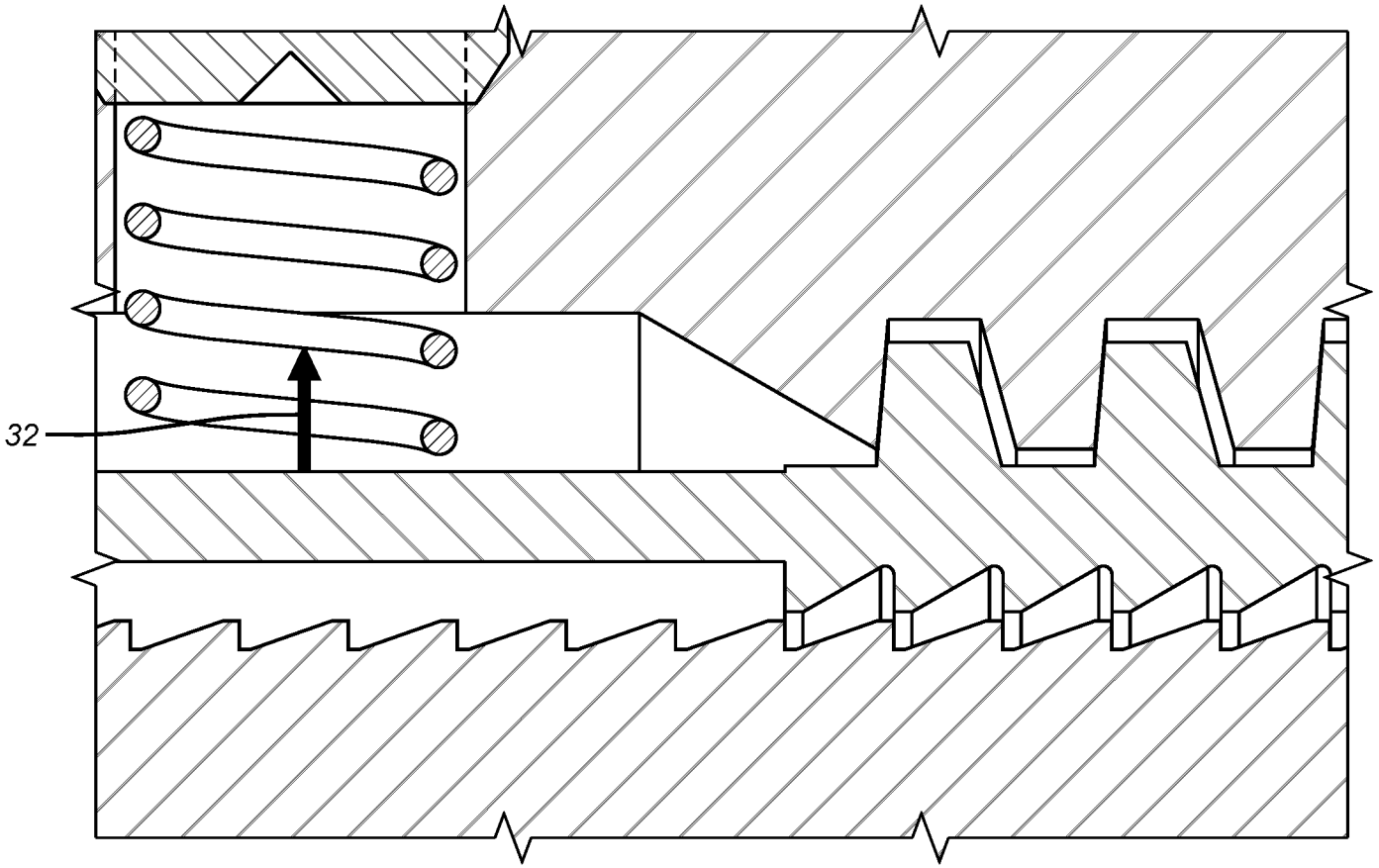
FIG. 4 is the view of FIG. 3 during ratcheting relative movement to the set position.

The engagement of outer profile 14 into outer assembly 18 and inner profile 26 serves to retain the segments 10 in an axial direction while providing the freedom of segments 10 to move radially toward mandrel 16 under the influence of spring or springs 28 and to move radially away from mandrel 16 due to the ratcheting movement between ramps 20*a* pushing on facing ramps 12*a* as mandrel 16 moves in the direction of arrow 22. Profiles 14 and 26 have conforming shapes with profile 26 being slightly larger axially and radially so that conforming profile 14 can move radially into profile 26 without bottoming out and to leave an axial clearance between the two to facilitate the radial movement of segments 10 into and out of profile 26. Profiles 14 and 26 can comprise a continuous spiral, a series of parallel peaks and valley that can be trapezoidal in shape as shown in FIG. 4 or rounded or rectangular shaped. Triangular, quadrilateral or rounded shapes can be used as well as other mating shapes. An undulating sinusoidal shape in section can also serve as profiles 14 and 26. The common theme in the engaged profiles 14 and 26 is that the segments 10 are axially supported between the mandrel 16 and the outer assembly 18 while permitting clearance within the mating profiles 14 and 26 to allow the segments 10 freedom to be biased toward the mandrel 16 by spring 28 and to be pushed radially away from mandrel 16 by the ratcheting action as mandrel 16 moves in the direction of arrow 22.

Figure 5:
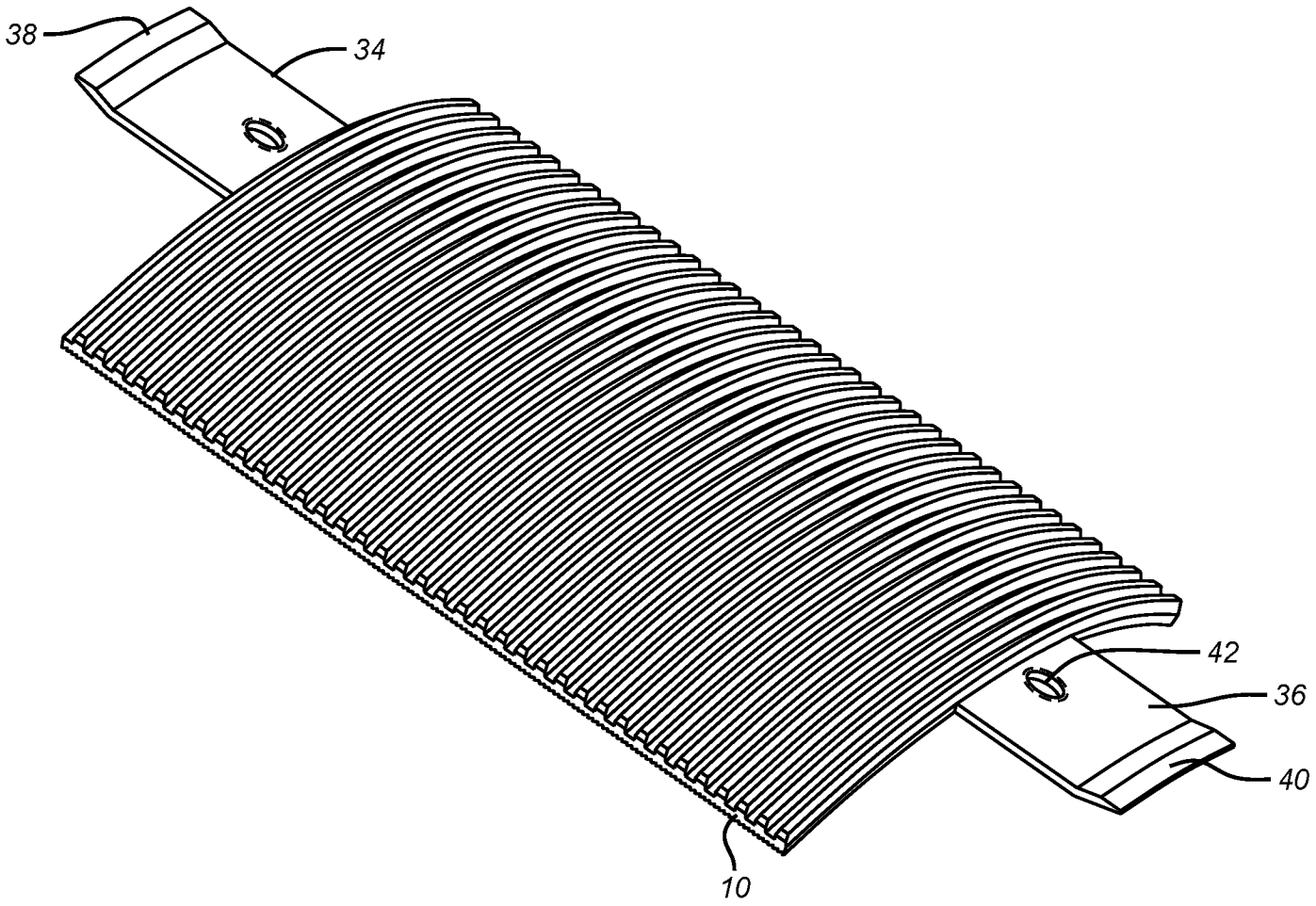
FIG. 5 is a perspective view of a lock ring segment showing end tabs that can store a potential energy force for the locking segment against an internal ratchet profile on a mandrel.

FIG. 5 illustrates an alternative to end springs 28 in the use of axially extending tabs 34 and 36 that have raised end segments 38 and 40 respectively. When the outer assembly 18 is mounted over mandrel 16 the portions 34 and 36 push the segment 10 toward the mandrel 16 but the ratcheting action allows axially oriented tabs 34 and 36 to flex radially to enable the radial movement of segments 10 needed for effective ratcheting action. A fastener can be placed into openings from the outer housing 18 to maintain support axially for the segments 10 during the ratcheting caused by moving mandrel 16 in the direction of arrow 22. Tabs 34 and 36 can be guided by the fastener that fits through openings 42 so that radial flexing of segments 10 is enabled at a time when the segments 10 are radially supported. Alternatively the segments 10 can be guided on their opposed edges in a way that enables the needed radial movement.

Figure 6:
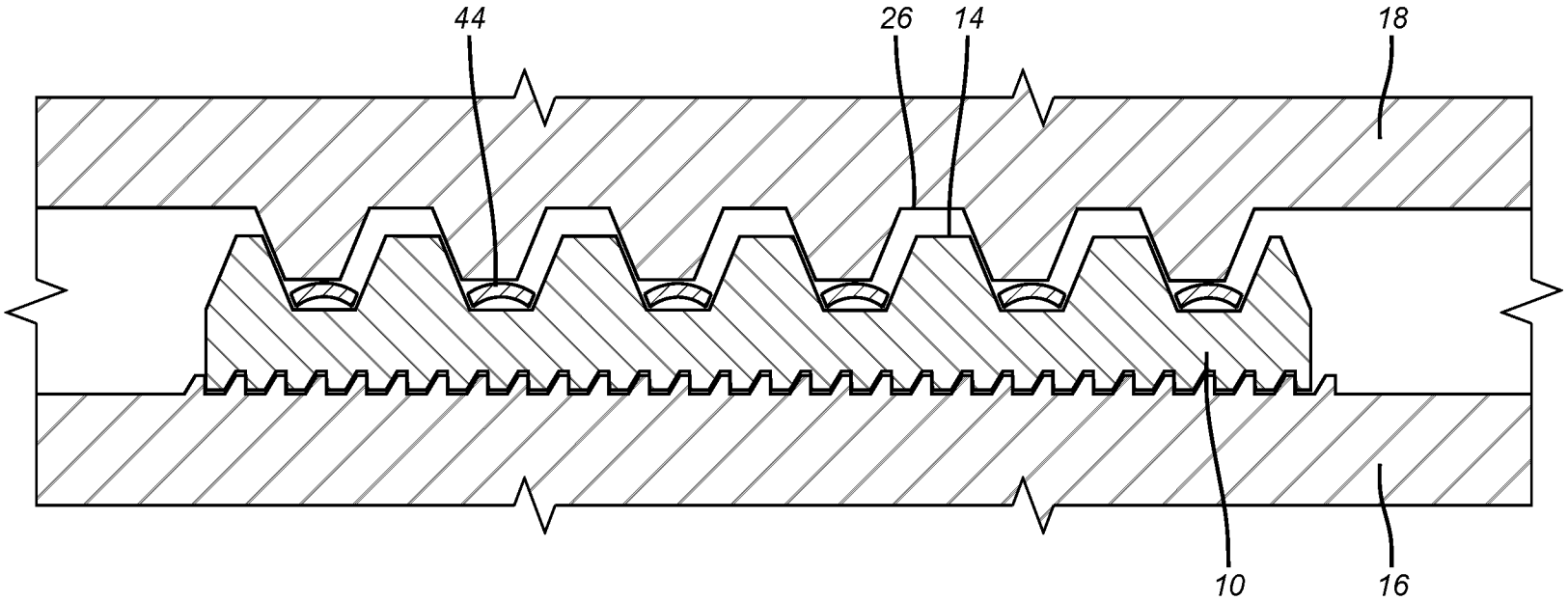
FIG. 6 shows biasing of the lock ring segment between ends with a wave spring.

FIG. 6 shows the use of one or more wave springs 44 to bias the segments 10 toward mandrel 16. In this example the bias is within the meshing profiles 14 and 26 rather than at opposed ends as in FIGS. 3 and 4 where springs 28 straddle the ends of the engaged profiles 14 and 26. The wave springs 44 can discrete segments or a continuous spiral shape depending on the shape of the profiles 14 and 26. As an alternate to metallic wave springs segments or a continuous piece of a resilient material such as rubber or another material compatible with well conditions can be used to provide the spring bias toward the mandrel 16. Belleville washers are another possible alternative for bias of the segments 10 toward the mandrel 16. In FIG. 6 the springs 44 are shown in the valleys of profile 14 but they can also be disposed on the peaks instead or in the peaks and the valleys.

Those skilled in the art will appreciate that the segmented locking members can be radially biased toward the mandrel with spring force at one or opposed ends of an exterior profile or from within the exterior profile with wave springs or with a resilient material. The use of an exterior profile that engages a mating profile in an outer housing provides axial support for the locking segments while allowing freedom of radial movement in opposed directions toward and away from the mandrel. The use of multiple support surfaces in the outer locking segment profile and the surrounding outer housing distributes axial locking load so as to reduce stress on each bearing surface or on a continuous or segmented spirally oriented surface. In section these mating profiles can feature a series of parallel ridges, a sinusoidal shape, rectangular or square or trapezoidal profile shapes whether the profile is a continuous thread or spiral or a segmented thread or spiral or is simply a series of parallel discrete profiles regardless of orientation perpendicular or skewed with respect to the mandrel axis. Flexing end tabs that are axially oriented can bias the locking segments toward a mandrel and allow opposed radial movement during ratcheting by flexing away from the mandrel, as illustrated in FIG. 7. While the locking segments are shown with a plurality of protruding shapes or a continuous or segmented protruding spiral shape, the pattern can be reversed with the locking segments having the female portion of the mating profile with the outer assembly having the male portion.

The above description is illustrative of the preferred embodiment and many modifications may be made by those skilled in the art without departing from the invention whose scope is to be determined from the literal and equivalent scope of the claims below:

We claim:

1. An assembly between a mandrel and an outer assembly which allows ratcheting relative axial motion between the mandrel and the outer assembly in a first direction and prevents relative axial motion between the mandrel and the outer assembly in a second direction opposed to said first direction, comprising:

a mandrel;

an outer assembly;

a plurality of radially movable locking segments having a mandrel facing profile and an outer assembly facing profile, said mandrel facing profile further comprising a first part of a ratcheting pair with a mandrel profile comprising a second part of the ratcheting pair such that said first direction axial relative movement between said mandrel and said locking segments pushes said locking segments radially away from said mandrel and toward said outer assembly against the force of at least one biasing member, said biasing member biasing a respective said locking segment toward said mandrel, said ratcheting pair, under force from said at least one biasing member, enabling the prevention of said second direction axial relative movement;

said outer assembly facing profile on said locking segments engageable to a facing meshing profile on said outer assembly for axial support of said locking segments at multiple axially spaced locations; and said biasing member is disposed on at least one side of said outer assembly facing profile; and said biasing member comprises at least one spring which comprises a coil which contacts and is compressed between the outer assembly and at least one of the locking segments.

2. The assembly of claim 1, wherein:

said outer assembly facing profile of said locking segments comprising a plurality of axially spaced projections extending toward said outer assembly.

3. The assembly of claim 2, wherein:

said spaced projections have a rectangular, trapezoidal or rounded shape.

4. The assembly of claim 1, wherein:

said outer assembly facing profile of said locking segments comprising a plurality of axially spaced depressions extending toward said mandrel.

5. The assembly of claim 4, wherein:

said spaced depressions have a rectangular, trapezoidal or rounded shape.

6. The assembly of claim 1, wherein:

said outer assembly facing profile of said locking segments comprising a spiral or a thread pattern.

7. The assembly of claim 6, wherein:

said spiral or thread pattern is segmented.

8. The assembly of claim 1, wherein:

said outer assembly facing profile of said locking segments comprising spaced parallel ridges oriented perpendicularly or askew of a longitudinal axis of said mandrel.

9. The assembly of claim 1, wherein:

said at least one spring is guided by said outer assembly.

10. The assembly of claim 1, wherein:

said at least one spring is guided internally or externally by said outer assembly or said profile or by said segment outside of said profile on said segment.

11. An assembly between a mandrel and an outer assembly which allows ratcheting relative axial motion between the mandrel and the outer assembly in a first direction and prevents relative axial motion between the mandrel and the outer assembly in a second direction opposed to said first direction, comprising:

a mandrel;

an outer assembly;

a plurality of radially movable locking segments having a mandrel facing profile and an outer assembly facing profile, said mandrel facing profile further comprising a first part of a ratcheting pair with a mandrel profile comprising a second part of the ratcheting pair such that said first direction axial relative movement between said mandrel and said locking segments pushes said locking segments radially away from said mandrel and toward said outer assembly against the force of at least one biasing member, said biasing member biasing a respective said locking segment toward said mandrel, said ratcheting pair, under force from said at least one biasing member, enabling the prevention of said second direction axial relative movement;

said outer assembly facing profile on said locking segments engageable to a facing meshing profile on said outer assembly for axial support of said locking segments at multiple axially spaced locations;

said at least one biasing member is disposed within said outer assembly facing profile;

said biasing member comprises at least one spring which comprises one or more resilient members which are disposed within valleys of the outer profile of the segment and are compressed between the outer assembly and the locking segment to bias the locking segment toward the mandrel.

* * * * *